US010772433B2

(12) United States Patent
Østrem

(10) Patent No.: US 10,772,433 B2
(45) Date of Patent: Sep. 15, 2020

(54) ELEVATION HINGE

(71) Applicant: TO3DESIGN Torbjørn Østrem, Vennesla (NO)

(72) Inventor: Torbjørn Østrem, Vennesla (NO)

(73) Assignee: TO3DESIGN Torbjørn Østrem, Vennesla (NO)

( * ) Notice: Subject to any disclaimer, the term of this patent is extended or adjusted under 35 U.S.C. 154(b) by 6 days.

(21) Appl. No.: 16/093,786

(22) PCT Filed: May 23, 2017

(86) PCT No.: PCT/NO2017/050126
§ 371 (c)(1),
(2) Date: Oct. 15, 2018

(87) PCT Pub. No.: WO2017/209621
PCT Pub. Date: Dec. 7, 2017

(65) Prior Publication Data

US 2019/0125083 A1 May 2, 2019

(30) Foreign Application Priority Data

May 31, 2016 (NO) ..... 20160928

(51) Int. Cl.
*A47C 7/54* (2006.01)
*A47B 96/07* (2006.01)
(Continued)

(52) U.S. Cl.
CPC ..... *A47C 7/543* (2013.01); *A47B 5/04* (2013.01); *A47B 96/07* (2013.01); *A47C 1/12* (2013.01);
(Continued)

(58) Field of Classification Search
CPC .. A47B 5/04; A47B 96/07; A47C 1/12; A47C 1/124; A47C 7/566; A47C 7/58;
(Continued)

(56) References Cited

U.S. PATENT DOCUMENTS

RE20,963 E * 1/1939 Meltzer ..... A47C 1/023 297/331
2,226,861 A * 12/1940 Hanson ..... A47C 7/566 297/331
(Continued)

FOREIGN PATENT DOCUMENTS

DE 202005017771 2/2006

OTHER PUBLICATIONS

Norwegian Search Report, Norwegian Patent Application No. 20160928, dated Dec. 14, 2016.
(Continued)

*Primary Examiner* — William L Miller
(74) *Attorney, Agent, or Firm* — Andrus Intellectual Property Law, LLP

(57) ABSTRACT

An elevation hinge where one of the parts moves in connection to a guiding means on another part, and wherein a supporting effect is achieved on an elevation of said moving part. The elevation hinge comprises a first part including at least one guiding means, and a second part including at least one connection element for guiding the second part along the at least one guiding means. The guiding means includes a second portion adapted for guiding the connection element to and from a first portion. Guidance is performed in a linear manner or in a rotational and linear manner, in relation to the first part. A spring is fixed between a connection element and an anchor pin on the first part.

15 Claims, 5 Drawing Sheets

(51) Int. Cl.

| | |
|---|---|
| ***A47C 1/12*** | (2006.01) |
| ***E05D 3/18*** | (2006.01) |
| ***A47B 5/04*** | (2006.01) |
| ***A47C 7/58*** | (2006.01) |
| ***A47C 7/56*** | (2006.01) |

(52) U.S. Cl.
CPC ..... *A47C 7/566* (2013.01); *A47C 7/58* (2013.01); *E05D 3/18* (2013.01); *E05Y 2900/20* (2013.01); *Y10T 16/5443* (2015.01)

(58) Field of Classification Search
CPC ..... A47C 7/543; E05D 3/18; E05Y 2900/20; Y10T 16/5406; Y10T 16/544; Y10T 16/5443; Y10T 16/5444; Y10T 16/5445; Y10T 16/5448; B60N 2/3047
USPC ..... 16/348, 357–361; 297/411.32, 331, 333; 108/134; 248/242, 250
See application file for complete search history.

(56) References Cited

U.S. PATENT DOCUMENTS

| | | | | | |
|---|---|---|---|---|---|
| 2,305,074 | A * | 12/1942 | Gedris | A47C 7/58 | 297/248 |
| 2,479,361 | A * | 8/1949 | Hower | A47C 7/62 | 297/217.1 |
| 2,492,111 | A * | 12/1949 | Prosser | A47C 7/566 | 297/331 |
| 3,059,964 | A * | 10/1962 | Makowski | B60N 2/3047 | 297/13 |
| 3,572,826 | A * | 3/1971 | Barnes | A47C 1/124 | 297/249 |
| 3,600,033 | A | 8/1971 | Holdampf et al. | | |
| 3,703,312 | A * | 11/1972 | Chapman | A47C 1/126 | 297/35 |
| 4,639,037 | A * | 1/1987 | Maruyama | A47C 9/06 | 248/240.4 |
| 4,652,051 | A * | 3/1987 | Maruyama | B60N 2/3047 | 297/333 |
| 5,141,284 | A * | 8/1992 | LaPointe | A47C 1/0352 | 297/85 L |
| 5,927,808 | A * | 7/1999 | Esker | B60N 2/3047 | 16/324 |
| 6,582,020 | B1 * | 6/2003 | Tenenboym | A47C 1/121 | 297/188.14 |
| 6,755,468 | B1 * | 6/2004 | Pan | A47C 3/045 | 297/239 |
| 8,157,326 | B2 * | 4/2012 | Raymond | B60N 2/1695 | 297/333 |
| 8,439,444 | B2 * | 5/2013 | Ngiau | B60N 2/22 | 297/378.12 |
| 8,474,910 | B2 * | 7/2013 | Kammerer | B60N 2/22 | 297/334 |
| 8,616,631 | B2 * | 12/2013 | Westerink | B64D 11/064 | 297/188.1 |
| 8,801,101 | B2 * | 8/2014 | Dagcioglu | B60N 2/3011 | 296/65.09 |
| 2002/0130542 | A1 * | 9/2002 | Ellerich | B60N 2/01583 | 297/331 |
| 2004/0075323 | A1 * | 4/2004 | Blair | B60N 2/06 | 297/331 |
| 2004/0113410 | A1 * | 6/2004 | Morino | B60N 2/3011 | 280/808 |
| 2005/0077770 | A1 * | 4/2005 | Lang | B60N 2/01583 | 297/331 |
| 2011/0187170 | A1 * | 8/2011 | Lin | A47C 1/121 | 297/333 |
| 2013/0057039 | A1 * | 3/2013 | Zeimis, III | B60N 2/682 | 297/333 |

OTHER PUBLICATIONS

International Search Report, PCT/NO2017/050126, dated Aug. 21, 2017.
Written Opinion, PCT/NO2017/050126, dated Aug. 21, 2017.

* cited by examiner

ELEVATION HINGE

TECHNICAL FIELD

The present solution relates to an elevation hinge.

BACKGROUND ART

Most rooms with an area intended for seating an audience, such as a theatre or a cinema hall, are furnished with rows of retractable chairs, which spontaneously hold the seat on an upright position at a standby elevation when not in use, and allow rotating and lowering the seat to a supporting elevation in order to use it as a physical support.

This type of retracting behaviour aims at providing free space when the rotating part is not being used. This has practical advantages, for example an improved manoeuvring space for allowing users to walk around without colliding with the rotating seat, or a better access for cleaning purposes of the surface beneath the rotating part.

This type of mechanical behaviour is also known from many other applications besides seats, such as armrests, tables or shelves.

In order for the known solutions to allow movement of the rotating part onto the supporting state, they merely block the rotating part from rotating down more than a certain elevation, or pitch, angle. Since the force that is supported, e.g. a user's weight, has the same direction of the rotation to move the rotating part to the supporting state, the approach of merely allowing the rotation until a certain elevation angle and then blocking it, is the known solution in these cases. Document DE 202005017771 U1 describes a collapsible chair for a sports stadium, in which, when extended out of a protecting box, there is provided an object similar to a retractable chair. In that state, the movement of the seat to the supporting state has the same direction of the weight that can be supported, and, at an elevation angle corresponding to the supporting state, the seat is obstructed from hinging down any more.

GENERAL DESCRIPTION

Disclosed is an elevation hinge, comprising:

- a first part comprising at least one guiding means; and
- a second part comprising at least one connection element for guiding the second part along the at least one guiding means, where the at least one guiding means of the first part guides the second part by means of the at least one connection element of the second part, between a standby elevation and a supporting elevation, where the at least one guiding means is adapted for guiding the at least one connection element in a linear manner, in a rotational manner or in a linear and rotational manner in relation to the first part, and where the at least one guiding means comprises:

- at least one first portion adapted for supporting the at least one connection element when the second part is on the supporting elevation; and
- at least one second portion adapted for guiding the at least one connection element to and from the at least one first portion in a linear manner or in a rotational and linear manner in relation to the first part.

The elevation hinge allows moving the second part in relation to the first part between a supporting elevation and a standby elevation. A supporting elevation is one on which the second part is capable of holding something else up. On a standby elevation, on the contrary, the second part is not capable of holding something else up.

The guidance of the second part in relation to the first part is performed by the interaction between the at least one connection element of the second part and the at least one guiding means of the first part. When a force is applied to the second part, which in turn is transmitted to the at least one connection element, it is the at least one guiding means of the first part that will be reacting to said force and manoeuvring the at least one connection element, which in turn manoeuvres the second part.

The at least one guiding means reacts to the forces applied to second part with a guidance of said part in relation to the first part. This guidance can be performed in a linear manner, for example by moving the second part's mass linearly in relation to the first part. It can also be performed in a rotational manner, for example by establishing a pivot point on the first part in relation to which the second part performs a rotation in relation thereto. Or it can also be performed in a rotational and linear manner, for example by combining both scenarios and rotating the second part in relation to the pivot point at the same time said pivot point changes its position on the first part, hence also moving the second part's mass linearly in relation to the first part.

In order to achieve the supporting effect at the supporting elevation, the at least one guiding means of the first part comprises at least one first portion adapted for supporting the at least one connection element. Said at least one first portion holds the second part up, due to the mechanical connection through the at least one connection element, which in turn is capable of holding something else up.

Also, the at least one guiding means of the first part comprises at least one second portion adapted for guiding the at least one connection element to and from the at least one first portion. This guidance to and from the at least one first portion is performed in a linear manner or in a rotational and linear manner in relation to the first part. For example, it either moves the second part's mass linearly in relation to the first part, or it rotates the second part in relation to a pivot point on the first part, at the same time said pivot point changes its position on the first part. This feature results on a continuous motion of the second part to and from the supporting elevation.

In one embodiment, the standby elevation is lower than the supporting elevation.

Establishing a standby elevation lower than the supporting elevation is not solved by merely allowing the rotation until a certain elevation angle and then blocking it. This is not possible because at said blocking elevation there is no supporting effect. On the contrary, the present solution combines the reaction of the at least one first portion with the reaction of the at least one second portion to result on a continuous motion of the second part to and from the supporting elevation, at the same time it provides a supporting elevation.

This embodiment efficiently achieves supporting the second part when the standby elevation is lower than supporting elevation. For example, on a boat is preferable to have a seat comprising the present solution with a standby elevation lower than the supporting elevation. There are other scenarios on which this embodiment is also preferable.

In another embodiment, the at least one first portion of the at least one guiding means of the first part, comprises at least one protruding means for locking the guidance of the at least one connection element in a linear manner in relation to the first part.

Due to the force being supported on the second part, which is mechanically transmitted to the at least one connection element, the at least one protruding means locks the linear movements of the at least one connection element on the at least one first portion of the guiding means. With at least one protruding means on the at least one first portion, the at least one connection means will only move to the at least one second portion when there is no force being supported on the second part.

This locking effect is important for applications where the guidance of the second part is freely allowed between the supporting elevation and a standby elevation, but when the at least one connection element is on the at least one first portion at the supporting elevation and a force is being supported on the second part, then linear movements are locked, hence avoiding unexpected transitions of the second part from the supporting elevation to a standby elevation.

In a further embodiment, the elevation hinge comprises at least one spring between a connection element of the second part and the first part, for applying a force on the connection element when this is on a second portion and guiding the connection element to a first portion.

When the at least one connection element reaches the at least one second portion of the guiding means, the spring provides a spontaneous behaviour for guiding the at least one connection element to a first portion. This effect is also achieved with an embodiment where the second part has a weight distribution adapted for applying a force on the connection element when this is on a second portion and guiding the connection element to a first portion.

In one embodiment, the at least one guiding means of the first part is at least one slot on the first part, and the at least one connection element of the second part is at least one pin on the second part.

In another embodiment, the at least one connection element of the second part comprises a nut fastened on the end of the connection element opposing the second part.

Herein is also disclosed a chair, an armrest, a shelf and a table, any of which comprising the elevation hinge according to the invention.

BRIEF DESCRIPTION OF DRAWINGS

In the following is described examples of preferred embodiments illustrated in the accompanying drawings, wherein.

DETAILED DESCRIPTION

Some embodiments of the present solution are herein described.

Figure 1A:
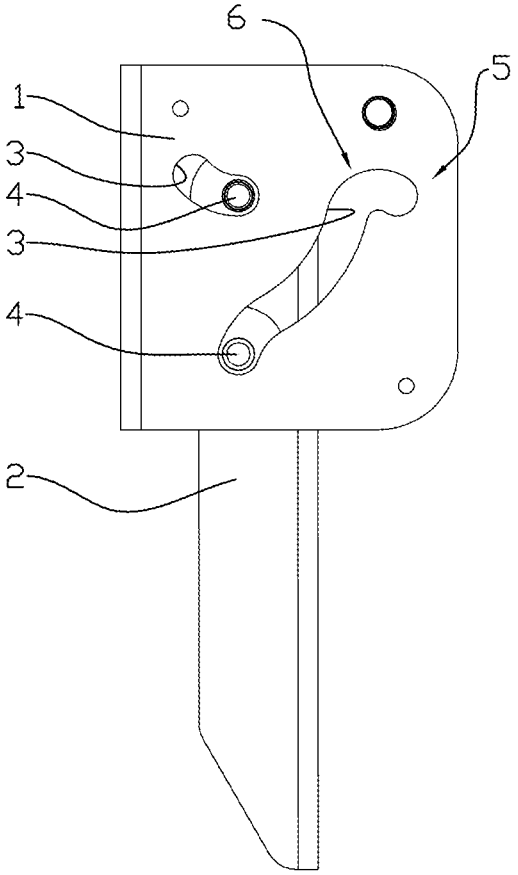
FIG. 1A-B illustrate a first embodiment of the elevation hinge when not in use.
Figure 1B:
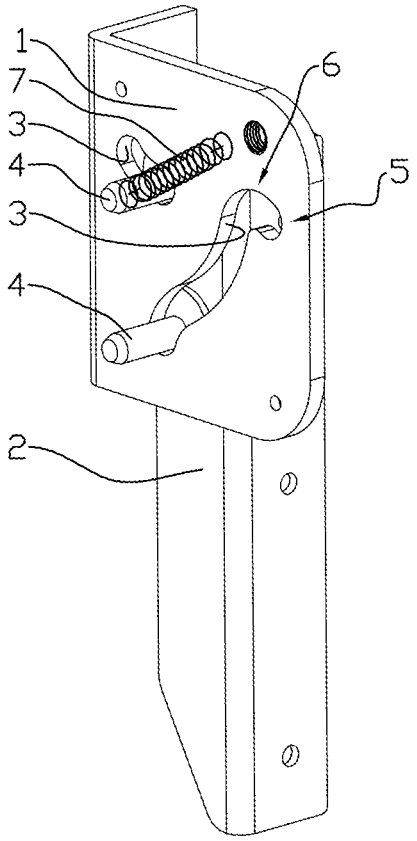
Figure 2A:
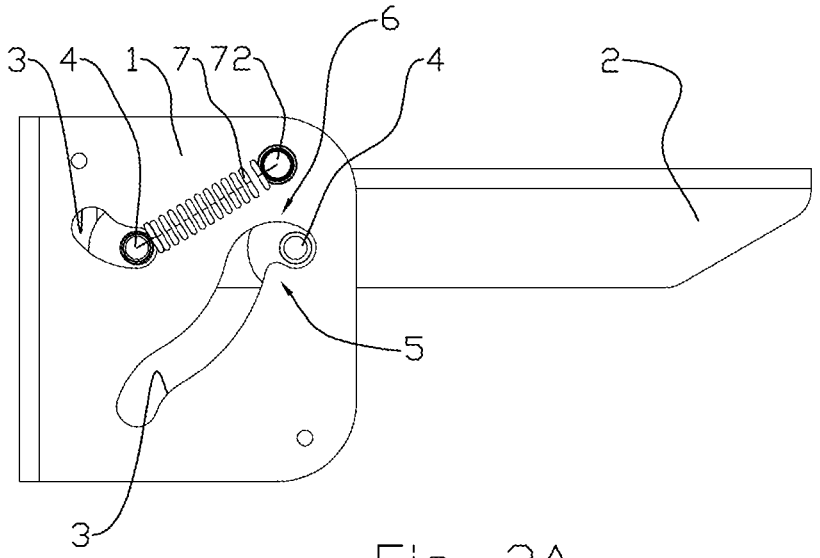
FIG. 2A-B illustrate a first embodiment of the elevation hinge when in use.
Figure 2B:
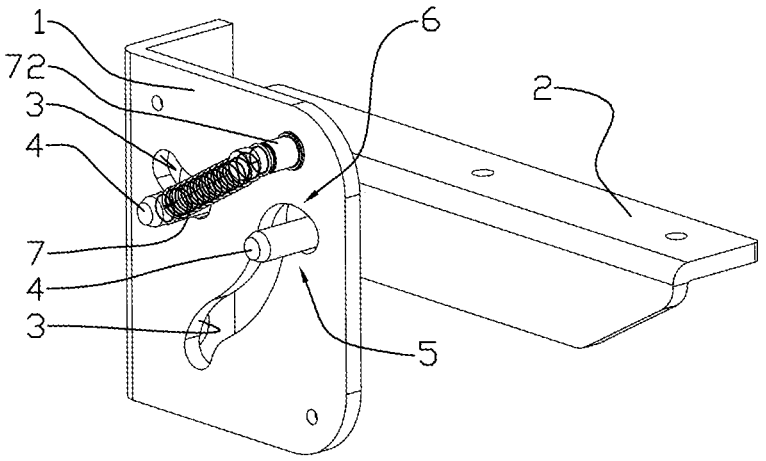

A first embodiment is illustrated on FIGS. 1A, 1B, 2A and 2B. FIGS. 1A and 1B illustrate the embodiment on a standby elevation, when not in use. For example, if the second part 2 would have a seat attached to it, then these figures would illustrate the seat on a lowered position, pointing to the ground. On FIGS. 2A and 2B illustrations are presented for this embodiment on the supporting elevation, when it is being used.

In this embodiment, the first part 1 has two slots as guiding means 3. The second part 2 has two pins, each as a connection element 4, for guiding the second part 2 along the two slots on the first part 1. Each pin from the second part 2 connects to a slot on the first part 1.

On one portion, the slots are adapted to guide the second part 2 in relation to the first part 1 in a rotational manner, in order to rotate to and from the supporting elevation, at which the second part 2 is supported. Furthermore, one of the slots also includes a first portion 5, on one end, for supporting the second part 2. One of the slots also comprises a second portion 6 where the second part 2 is guided in relation to first part 1 in a rotational and linear manner. Also observable on the first portion 6 is a protrusion for locking the guidance of a pin in a linear manner in relation to the first part 1.

A spring 7 applying tension to one of the pins is also shown on this embodiment on FIGS. 1B, 2A and 2B. This spring applies a force on one of the pins and guides it to the first portion 5 at the supporting elevation. On the figures, the spring is fixed between a pin on the second part 2 and an anchor pin 72 on the first part 1.

Figure 3A:
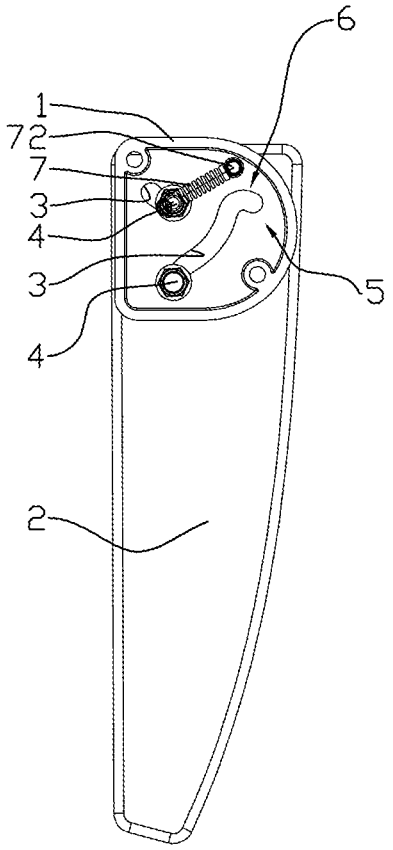
FIG. 3A-B illustrate a second embodiment of the elevation hinge when not in use.
Figure 3B:
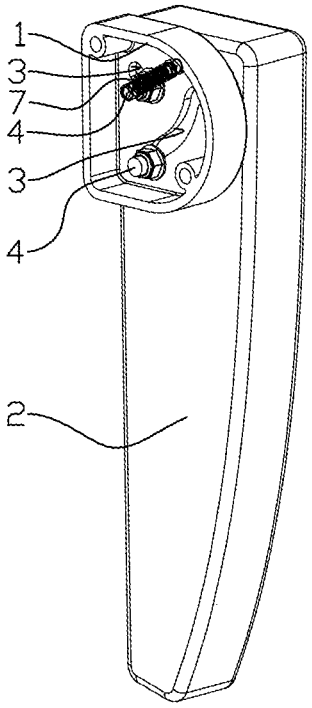
Figure 4A:
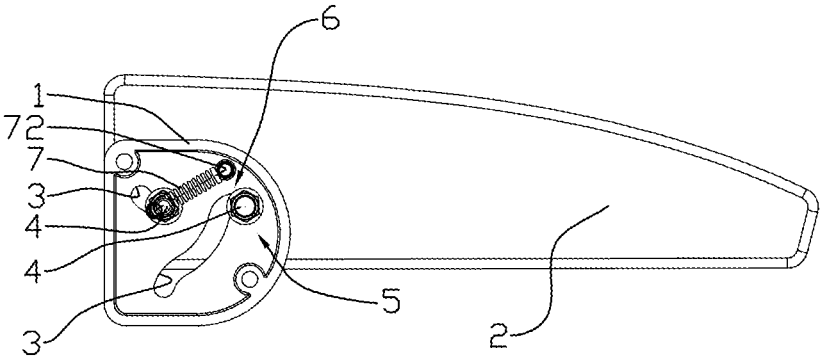
FIG. 4A-B illustrate a second embodiment of the elevation hinge when in use.
Figure 4B:
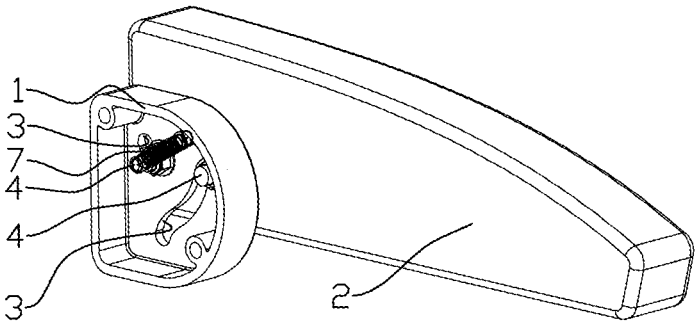

A second embodiment is shown in FIGS. 3A, 3B, 4A and 4B. FIGS. 3A and 3B show the embodiment at a standby elevation, when not in use, and FIGS. 4A and 4B show the embodiment at a supporting elevation, when in use. This second embodiment is similar to the first one, but the second part 2 is ready for supporting a weight, without needing any additional part being attached to it, e.g. a seat or a shelf. In this embodiment, the second part 2 is itself an armrest. A protrusion is also observable on the first portion 6 for locking the guidance of a pin in a linear manner in relation to the first part 1.

The pins that connect the second part 2 to the slots on the first part 1 include nuts fastened on the end of the pin opposing the second part 2 in relation to the slot.

FIGS. 5A-G show a sequence of positions of the second part 2 moving between the standby elevation and the supporting elevation.

Figure 5A:
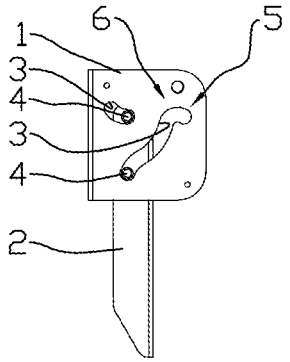
FIG. 5A-G illustrates an embodiment where the second part is moved to a horizontal supporting elevation.

On FIG. 5A, the second part 2 starts on a vertical, standby position, where it points to the floor. The two connection elements 4 that connect the second part 2 to the guiding means 3 on the first part 1, in this case this is two slots, are positioned at the respective ends of said slots.

Figure 5B:
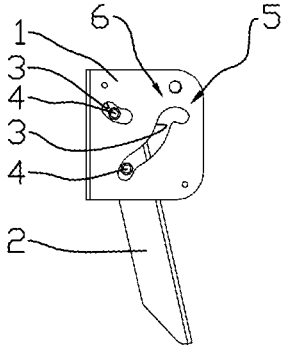

When observing FIG. 5B taking FIG. 5A as the previous state, a first movement is perceivable, as having been performed by the second part 2. It is observable that the second part 2 was guided in a linear and rotational manner in relation to the first part 1. With this embodiment, not only a rotation occurred around a pivot point, but also said pivot point has moved in relation to the first part 1.

Figure 5C:
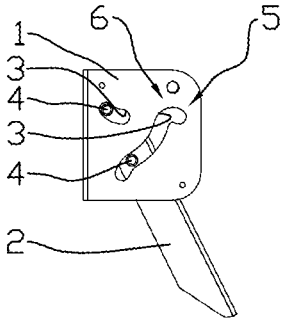
Figure 5D:
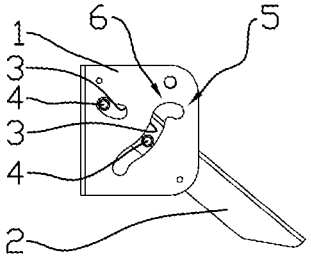
Figure 5E:
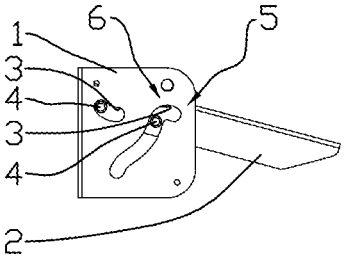

FIGS. 5C, 5D and 5E show the second part 2 in intermediate positions, being moved in a rotational manner in relation to the first part 1.

Figure 5F:
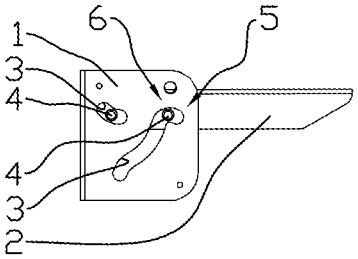

FIGS. 5E and 5F show the second portion 6 on the outer slot guiding the outer connection element 4 to the first portion 5 in a rotational and linear manner in relation to the first part 1. The linearity of the movement in relation to the first part 1 is observable by comparing the positions of both connection elements 3 on the two figures. Furthermore, the skilled person will easily see that this radial displacing behaviour can also be achieved with a second portion 6 which only guides the second part 2 on a linear manner in relation to the first part 1. For example, by adapting the outer slot with a cornered portion, instead of a curved portion like the one shown for the second portion 6 on the FIGS. 5A to 5G.

Figure 5G:
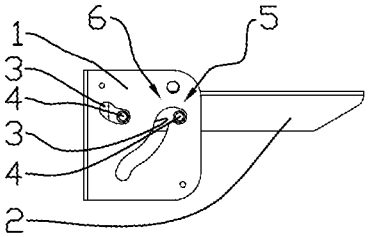

FIGS. 5F and 5G show the second part 2 reaching the supporting elevation by means of the connection elements 3 reaching the first portion 5. During this transition, the protrusion observable on the beginning of the first portion 5 was overpassed. Once the second part 2 reaches the first portion 5 a supporting effect is produced and also, due to the protrusion on the first portion 5, a locking effect, which locks the guidance of the connection elements 4 in a linear manner in relation to the first part 1. If this embodiment was used on a chair, for example by fixing a seat to the second part 2, then the protrusion would avoid that the seat would suddenly become unsupported when a user was seated, due to horizontal movements of the seat.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The invention claimed is:

1. An elevation hinge for at least one of a seat, an armrest, a table and a shelf, the elevation hinge comprising:

a first part comprising at least one guiding means; and a second part comprising at least one connection element for guiding the second part along the at least one guiding means, wherein the at least one guiding means of the first part guides the second part via the at least one connection element of the second part, between a standby elevation and a supporting elevation, when the second part is moved by an external force, wherein the at least one guiding means is adapted for guiding the at least one connection element in a linear manner, in a rotational manner or in a linear and rotational manner in relation to the first part, wherein the at least one guiding means comprises:

at least one first portion adapted for supporting the at least one connection element when the second part is on the supporting elevation; and at least one second portion adapted for guiding the at least one connection element to and from the at least one first portion in a linear manner or in a rotational and linear manner in relation to the first part, and wherein a distal end of the second part opposite the at least one connection element is lower in the standby elevation than the supporting elevation.

2. The elevation hinge according to claim 1, wherein the at least one first portion of the at least one guiding means of the first part, comprises at least one protruding means for locking the guidance of the at least one connection element in a linear manner in relation to the first part.

3. The elevation hinge according to claim 1, further comprising at least one spring between a connection element of the second part and the first part, for applying a force on the connection element when this is on a second portion and guiding the connection element to a first portion.

4. The elevation hinge according to claim 1, wherein the second part has a weight distribution adapted for applying a force on the connection element when this is on a second portion and guiding the connection element to a first portion.

5. The elevation hinge according to claim 1, wherein the at least one guiding means of the first part is at least one slot on the first part, and the at least one connection element of the second part is at least one pin on the second part.

6. The elevation hinge according to claim 1, wherein the at least one connection element of the second part comprises a nut fastened on the end of the connection element opposing the second part.

7. A chair comprising an elevation hinge comprising:

a first chair part comprising at least one guiding means; and a second chair part comprising at least one connection element for guiding the second chair part along the at least one guiding means, wherein the at least one guiding means of the first chair part guides the second chair part via the at least one connection element of the second chair part, between a standby elevation and a supporting elevation, when the second chair part is moved by an external force, wherein the at least one guiding means is adapted for guiding the at least one connection element in a linear manner, in a rotational manner or in a linear and rotational manner in relation to the first chair part, wherein the at least one guiding means comprises:

at least one first portion adapted for supporting the at least one connection element when the second chair part is on the supporting elevation; and at least one second portion adapted for guiding the at least one connection element to and from the at least one first portion in a linear manner or in a rotational and linear manner in relation to the first chair part, and wherein a distal end of the second chair part opposite the at least one connection element is lower in the standby elevation than the supporting elevation.

8. The chair of claim 7, wherein the first chair part comprises a first armrest part, and wherein the second chair part comprises a second armrest part.

9. A shelf comprising an elevation hinge comprising:

a first shelf part comprising at least one guiding means; and a second shelf part comprising at least one connection element for guiding the second shelf part along the at least one guiding means, wherein the at least one guiding means of the first shelf part guides the second shelf part via the at least one connection element of the second shelf part, between a standby elevation and a supporting elevation, when the second shelf part is moved by an external force, wherein the at least one guiding means is adapted for guiding the at least one connection element in a linear manner, in a rotational manner or in a linear and rotational manner in relation to the first shelf part, wherein the at least one guiding means comprises:

at least one first portion adapted for supporting the at least one connection element when the second shelf part is on the supporting elevation; and at least one second portion adapted for guiding the at least one connection element to and from the at least one first portion in a linear manner or in a rotational and linear manner in relation to the first shelf part, and wherein a distal end of the second shelf part opposite the at least one connection element is lower in the standby elevation than the supporting elevation.

10. A table comprising an elevation hinge comprising:

a first table part comprising at least one guiding means; and a second table part comprising at least one connection element for guiding the second table part along the at least one guiding means, wherein the at least one guiding means of the first table part guides the second table part, via the at least one connection element of the second table part, between a standby elevation and a supporting elevation, when the second table part is moved by an external force, wherein the at least one guiding means is adapted for guiding the at least one connection element in a linear manner, in a rotational manner or in a linear and rotational manner in relation to the first table part, wherein the at least one guiding means comprises:

at least one first portion adapted for supporting the at least one connection element when the second table part is on the supporting elevation; and at least one second portion adapted for guiding the at least one connection element to and from the at least one first portion in a linear manner or in a rotational and linear manner in relation to the first table part, and wherein a distal end of the second table part opposite the at least one connection element is lower in the standby elevation than the supporting elevation.

11. An elevation hinge assembly, comprising:

a first part having a first slot and a second slot formed therein, wherein the first slot extends from a standby end to a supporting end and the second slot extends from a first end to a second end; and a second part comprising a first pin and a second pin, wherein the first pin is configured to travel between the standby end and the supporting end within the first slot and the second pin is configured to travel between the first end and the second end within the second slot to permit the second part to pivot and translate relative to the first part between a standby position and a supporting position for supporting an object;

wherein the first pin is proximate the standby end of the first slot and the second pin is proximate the first end of the second slot when the second part is in the standby position and not in use for supporting the object; and wherein the first pin is proximate the supporting end of the first slot and the second pin is proximate the first end of the second slot when the second part is in the supporting position.

12. The elevation hinge assembly of claim 11, wherein the supporting end of the first slot is positioned above the standby end of the first slot relative to a horizontal plane.

13. The elevation hinge assembly of claim 11, wherein the first slot further comprises a protrusion positioned near the supporting end, the protrusion configured to prevent translational movement of the second part relative to the first part.

14. The elevation hinge assembly of claim 11, wherein the first part further comprises a spring coupled to the second pin of the second part.

15. The elevation hinge assembly of claim 11, wherein the second pin is proximate the second end of the second slot when the second part is in an intermediate position between the standby position and the supporting position.

* * * * *